US012553230B2

(12) United States Patent
Scherrer

(10) Patent No.: US 12,553,230 B2
(45) Date of Patent: Feb. 17, 2026

(54) GEODESIC DOME ACCESSORIES

(71) Applicant: William Bion Scherrer, Boise, ID (US)

(72) Inventor: William Bion Scherrer, Boise, ID (US)

(73) Assignee: Mandala Domes, LLC, Boise, ID (US)

( * ) Notice: Subject to any disclaimer, the term of this patent is extended or adjusted under 35 U.S.C. 154(b) by 287 days.

(21) Appl. No.: 18/296,280

(22) Filed: Apr. 5, 2023

(65) Prior Publication Data

US 2023/0313522 A1 Oct. 5, 2023

Related U.S. Application Data

(60) Provisional application No. 63/362,505, filed on Apr. 5, 2022.

(51) Int. Cl.
*E04B 1/32* (2006.01)
*E04B 7/10* (2006.01)

(52) U.S. Cl.
CPC ..... *E04B 1/3211* (2013.01); *E04B 7/102* (2013.01); *E04B 2001/3247* (2013.01); *E04B 2001/3276* (2013.01)

(58) Field of Classification Search
CPC ..... E04B 1/3211; E04B 2001/3247; E04B 2001/3252; E04B 2001/3276; E04B 2001/3288; E04B 7/102; E04B 7/105
See application file for complete search history.

(56) References Cited

U.S. PATENT DOCUMENTS

| | | | | | |
|---|---|---|---|---|---|
| 3,945,160 | A * | 3/1976 | Grosser | E04B 7/105 | D25/13 |
| 4,193,235 | A * | 3/1980 | Cucchiara | E06B 3/285 | 52/745.16 |
| 4,485,574 | A * | 12/1984 | Bennetot | D05C 9/04 | 38/102.2 |
| 9,103,110 | B1 * | 8/2015 | Gerber | E04C 2/38 | |
| 10,415,231 | B1 * | 9/2019 | Pramov | E04B 1/3211 | |
| 2017/0159280 | A1 * | 6/2017 | Nunn | E04B 1/3211 | |
| 2023/0314016 | A1 * | 10/2023 | Tejón | F24F 13/0272 | 52/173.1 |

FOREIGN PATENT DOCUMENTS

| | | | | |
|---|---|---|---|---|
| DE | 3145425 A1 * | 5/1983 | | |
| GB | 1109139 A * | 4/1968 | | |
| GB | 2497917 A * | 7/2013 | | E04B 1/32 |
| NL | 9002258 A * | 5/1992 | | E04B 1/3211 |

* cited by examiner

*Primary Examiner* — Christine T Cajilig
(74) *Attorney, Agent, or Firm* — Scott D. Swanson; Shaver Swanson

(57) ABSTRACT

A geodesic dome accessory having an accessory frame that utilizes a base frame and an upper frame. The base frame is attached to the frame of the geodesic dome on interior to the frame. The upper frame attaches to the base frame and secures the membrane of the geodesic dome between the upper frame and the base frame, providing a weather resistant or tight seal. The base frame forms an opening to access from the exterior of the dome to the interior. The upper frame can be in a variety of configurations, including a window, door, vent passage, or stove pipe passage. The structural framing of the dome can remain with the base frame in the shape of the opening between frame elements, such as a window, or the framing can be removed with the accessory base frame forming the structural support replacing the standard framing, such as a door.

20 Claims, 15 Drawing Sheets

GEODESIC DOME ACCESSORIES

CROSS-REFERENCE TO RELATED APPLICATIONS

This application claims the benefit of U.S. Provisional Application No. 63/362,505, filed Apr. 5, 2022, the disclosure of which is incorporated by reference.

FIELD OF THE INVENTION

The disclosure generally relates to the field of geodesic domes. Particular embodiments relate to dome accessories, in particular to an improved attachment mechanism for attaching dome accessories to a dome.

BACKGROUND OF THE INVENTION

A geodesic dome is a dome built out of a plurality of interconnected straight bars. The bars are arranged in a repeating pattern of triangular facets, with the triangles arranged into a geodesic polyhedron having a rounded surface. A thin membrane is then applied and attached to the outer area of the geodesic polyhedron. Doors and windows are typically positioned in the geodesic polyhedron during construction of the geodesic dome. However, these doors and windows are not easily removable nor is reconfiguring a geodesic dome a convenient option, and can lead to issues in weatherproofing the added structure to prevent water from passing through the added accessory.

Accordingly, what is needed is a convenient methodology for adding or removing or replacing openings in a geodesic dome without having to substantially alter the underlying structure of the dome.

SUMMARY

The purpose of the Summary is to enable the public, and especially the scientists, engineers, and practitioners in the art who are not familiar with patent or legal terms or phraseology, to determine quickly from a cursory inspection, the nature and essence of the technical disclosure of the application. The Summary is neither intended to define the inventive concept(s) of the application, which is measured by the claims, nor is it intended to be limiting as to the scope of the inventive concept(s) in any way.

What is disclosed is a system and method of adding accessories, such as: windows, doors, vents, and other pass-ways through the membrane of the geodesic dome. What is disclosed is a base frame, having the general shape of one of the repeating triangular structural patterns of the dome, such as a triangle, or configured to replace multiple segments of repeating triangular structural pattern. Alternatively, a base frame can be provided having the structure of multiple adjacent repeating base frame structures. For example, a window can be provided having a base frame of a triangle or alternatively a door of multiple triangles. The base frame is attached to the underlying frame of the geodesic dome. This base frame mimics the opening that is intended to provide a window or passage way therethrough.

The base frame is configured for attachment directly to the pre-existing frame of the geodesic dome. For example, in an embodiment utilizing a triangular base frame, brackets or tabs can be positioned at the corners of the triangle and configured for attachment directly to the underlying repeating triangular elements of the geodesic dome structure. This base frame is positioned directly below the membranous outer cover. Typically, this membranous outer cover is constructed of a vinyl in current standard dome constructions. An outer frame is then positioned and attached through the membrane directly to the base frame. This outer frame is positioned onto the base frame such that the membrane is positioned or sandwiched between the base frame and outer frame. The outer frame is then connected to the base frame. The membrane is then removed, such as by cutting the membrane internal to the base frame and outer frame. The membrane is sandwiched between the base frame and outer frame, providing a water-resistant seal. The accessory can be attached to the geodesic dome during assembly of the dome or alternatively used to retrofit a dome with the accessory.

A variety of different accessories can be used. This includes a stove pipe pass through, a window (either fixed or open), or alternatively a venting fan, such as a fan (including solar or an otherwise powered fan). Alternatively, the base frame can be formed such that it is positioned between a series of repeating structures such as repeating triangles. The base frame is attached to the frame of the repeating structures to remain outside of the accessory, such as triangular frames adjacent to a doorway. The base frame is attached, and the pre-existing frame structure of the dome over the accessory is removed. The outer frame, such as the door or window, can then be positioned on the base frame clamping the membrane between the base frame and outer frame, with the membrane interior to the accessory being removed. This provides a sandwiched clamped connection of the membrane between the outer frame and base frame.

Still other features and advantages of the presently disclosed and claimed inventive concept(s) will become readily apparent to those skilled in this art from the following detailed description describing preferred embodiments of the inventive concept(s), simply by way of illustration of the best mode contemplated by carrying out the inventive concept(s). As will be realized, the inventive concept(s) is capable of modification in various obvious respects all without departing from the inventive concept(s). Accordingly, the drawings and description of the preferred embodiments are to be regarded as illustrative in nature, and not as restrictive in nature

DETAILED DESCRIPTION OF THE INVENTION

Figure 1:
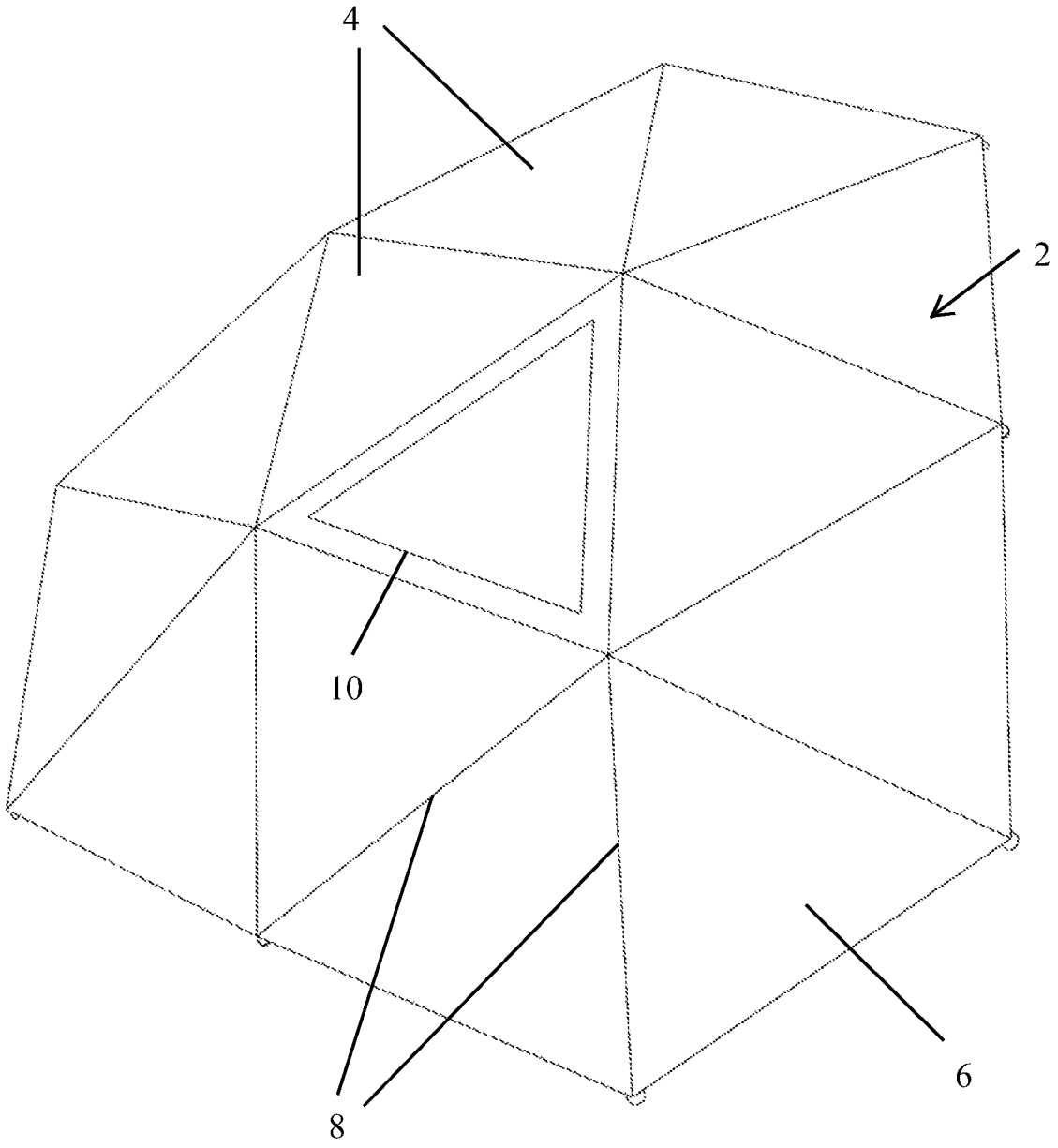
FIG. 1 is a partial view of an assembled geodesic dome having a window.

While the presently disclosed inventive concept(s) is susceptible of various modifications and alternative constructions, certain illustrated embodiments thereof have been shown in the drawings and will be described below in detail. It should be understood, however, that there is no intention to limit the inventive concept(s) to the specific form disclosed, but, on the contrary, the presently disclosed and claimed inventive concept(s) is to cover all modifications, alternative constructions, and equivalents falling within the spirit and scope of the inventive concept(s) as defined in the claims.

FIG. 1 illustrates a geodesic dome 2 having triangular elements 4 arranged to form a hemispherical structure. A membrane 6 is shown applied over the frame elements. The frame elements form a dome structure having repeating triangular forms to for the geodesic dome frame. An intended positioning of a window or other accessory 10 is illustrated in the geodesic dome.

Figure 2:
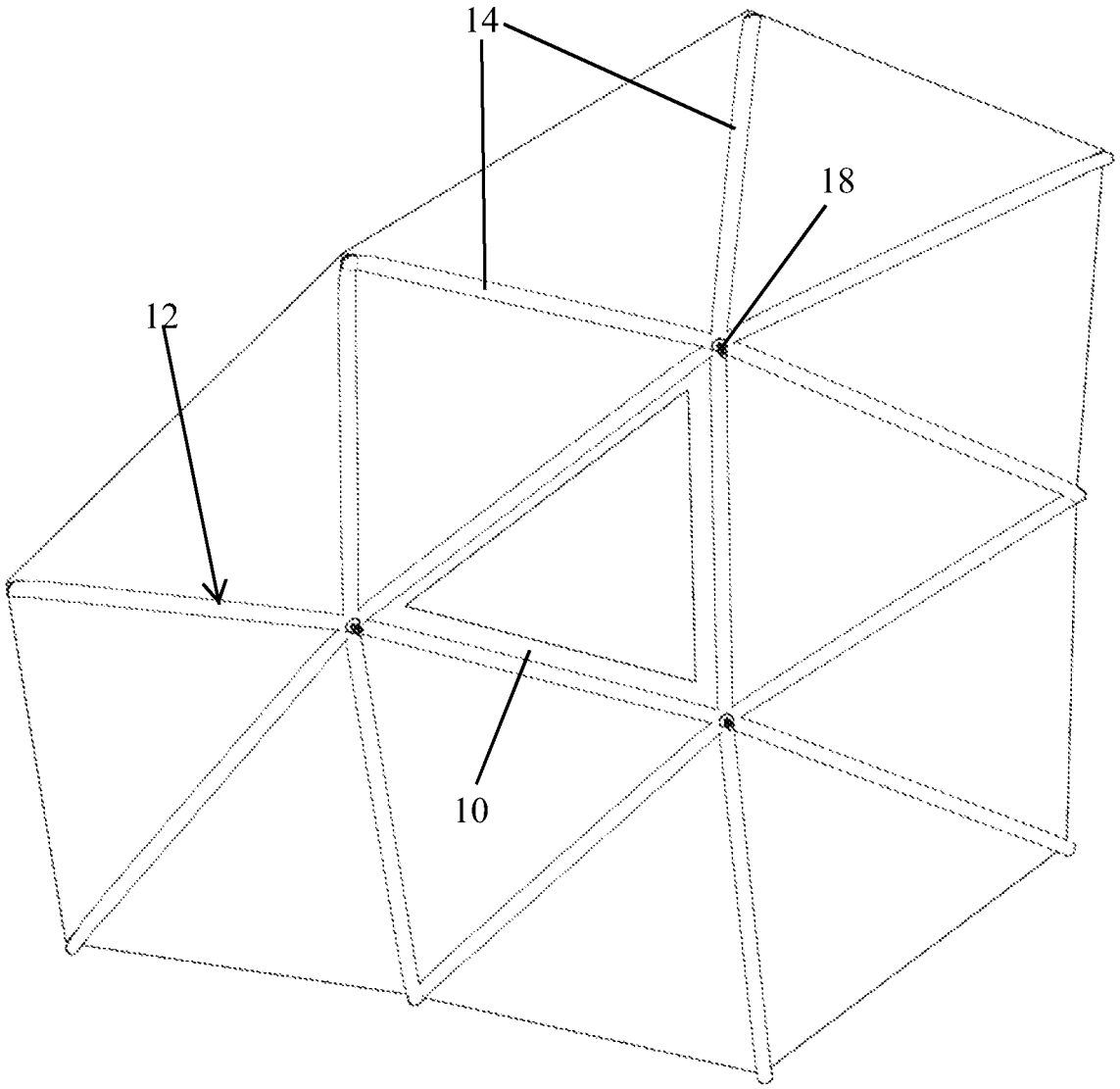
FIG. 2 is the partial view of FIG. 1 with the membrane removed illustrating the position of an accessory frame assembly attached to the frame of the geodesic dome.

FIG. 2 illustrates the geodesic dome of FIG. 1 with the membrane removed. The membrane is typically a vinyl substrate in current geodesic domes, although alternative substrates may be used. The frame elements are shown as tubing 14, which can be cylindrical or other shape, arranged in triangular elements 4 that are connected at the vertices 16, 18 of the triangles. The intended positioning of a window or other accessory 10 is shown by a triangular accessory frame assembly that is attached at the vertices of the main frame assembly by connectors at each vertices. The membrane is connected to the main frame assembly so as to provide a weather resistant attachment.

Figure 3:
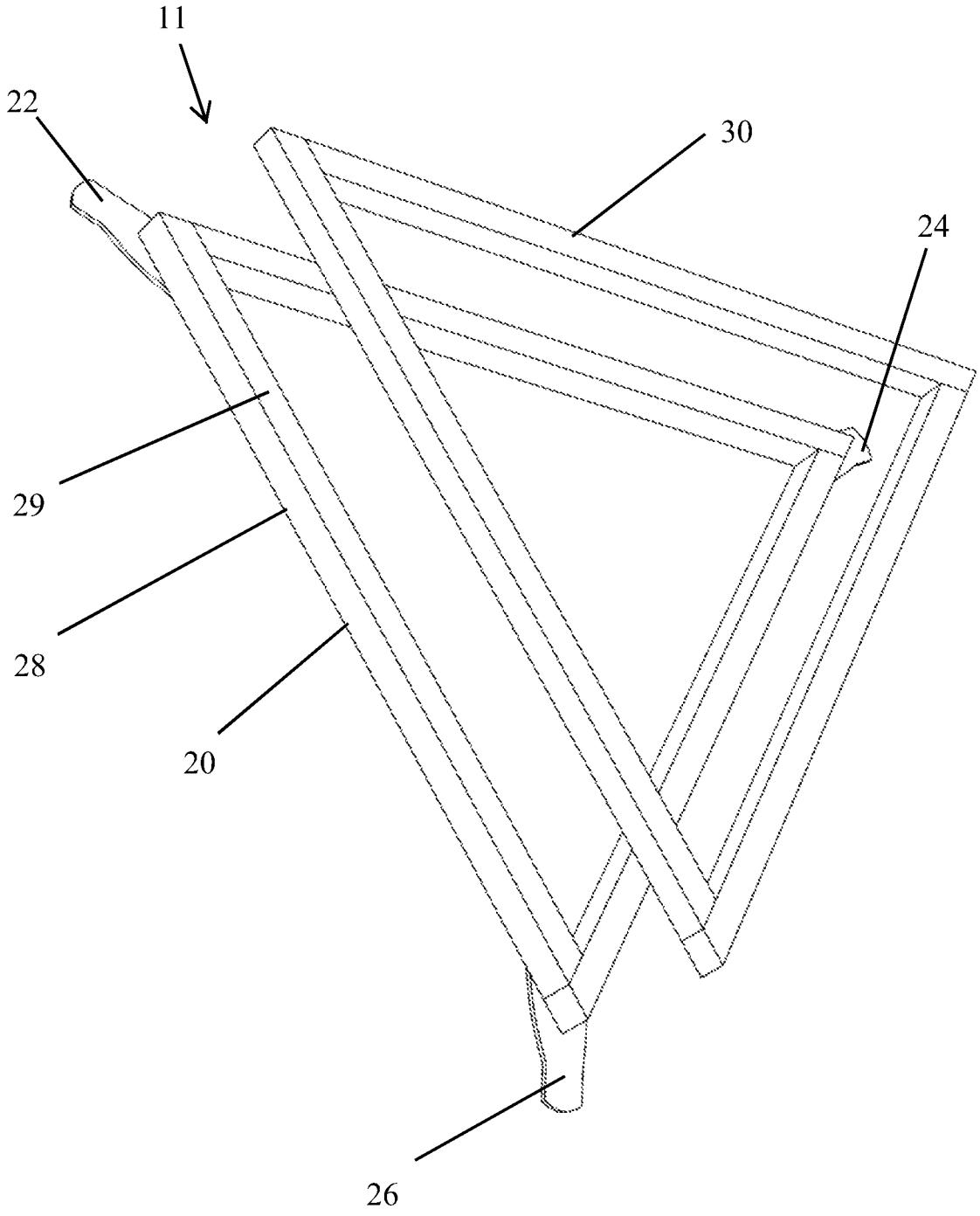
FIG. 3 is an exploded view of the base frame and upper frame of an accessory frame assembly.

FIG. 3 illustrates an exploded view of an accessory framing assembly 11 forming a window. This accessory frame assembly comprises a base frame and an outer frame. The base frame has an outer face 29 configured for attachment to the inner face of the outer frame such that the membrane of the geodesic dome is secured between the outer face of the base frame and the inner face of the outer frame (illustrated as 31 in FIG. 8). Preferably the base frame is configure to attach to the vertices, as illustrated in FIGS. 3-4, with a outer frame attaching to the base frame.

The base frame 20 is shown having connector tabs or brackets 22, 24, 26. The base frame is provided in a triangular orientation 28 but can otherwise be formed in a polyhedron to match the elements of alternative embodiments of a geodesic dome. The outer frame 30 is configured for nesting engagement with the base frame in the depicted embodiment.

Figure 4:
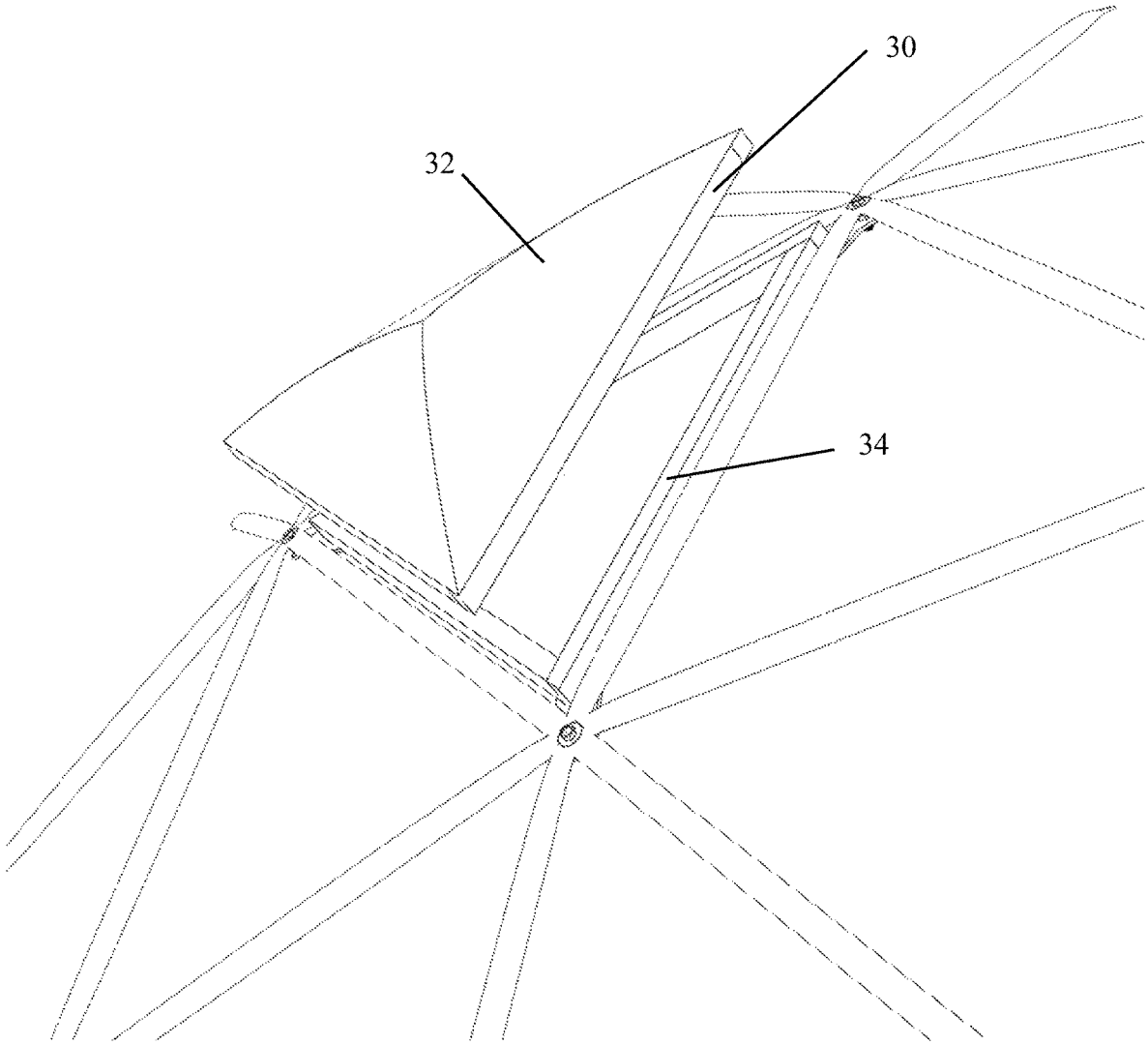
FIG. 4 is a partially exploded view of a base frame connected to the geodesic dome frame with the upper frame positioned away from the base frame.

FIG. 4 illustrates the base frame connected at the vertices of the triangles formed by the frame members. The outer frame comprises a fixed window 32. The outer frame 30 is positioned onto the face of base frame and connected by bolts extending through the outer frame and through the base frame. The orientation of the outer frame to the base frame retains the membrane between the outer frame and base frame, in other words the material is sandwiched between the base frame and outer frame 34. Alternatively the other frame and base frame can be connected by alternate mechanisms, such as by configuring the outer frame to be nested onto the base frame with connectors securing the outer frame to the base frame.

The inner frame is connected to the vertices internal to the vertices attaching adjacent triangles. The nesting face of the base frame extends through the triangle, extending outward beyond the frame elements of the triangle. The outer frame nests onto the nesting face of the base frame, and attaches by connectors, such as screws or bolts, or alternatively by an adhesive. To install, preferably the membrane is attached to the dome frame and positioned across the opening of the base frame of the accessory. The outer frame is then attached to the base frame, positioning and securing the membrane between the base frame and the outer frame. The membrane spanning the opening in the base frame can then be cut or otherwise removed from the opening. Weatherproofing material, such as silicon, can be applied to the accessory similar to installing traditional windows in conventional construction.

Figure 5:
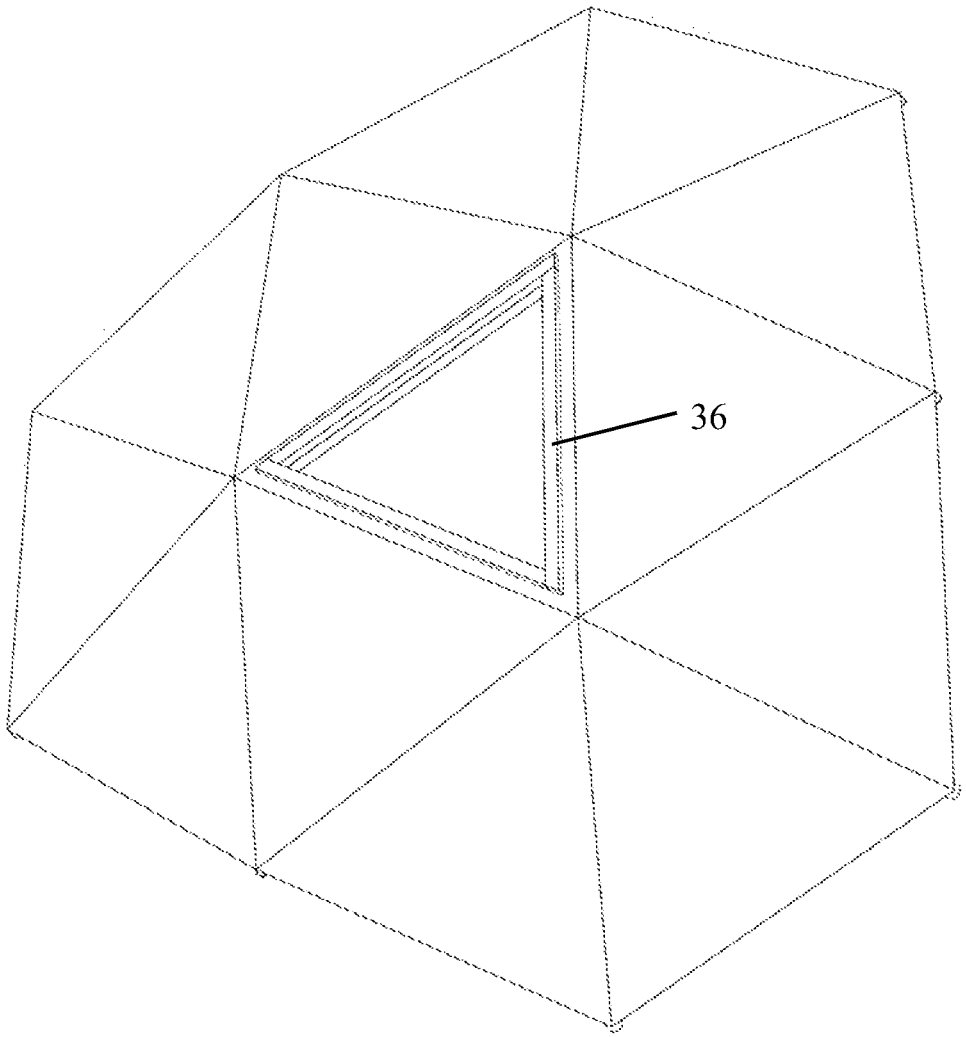
FIG. 5 is a partial view of a geodesic dome having an accessory in the form of a window installed in the dome.

FIG. 5 illustrates the assembled accessory 36, being a window, installed in a cutaway of a geodesic dome. The outer frame of the accessory frame assembly is attached to the base frame, with the membrane secured between the outer frame and the base frame. The membrane spanning the opening in the triangular base frame has been cut away, providing for a transparent window through the frame. While the depicted accessory forms a window, alternative accessories can be utilized, for example those shown in FIG. 6.

Figure 6:
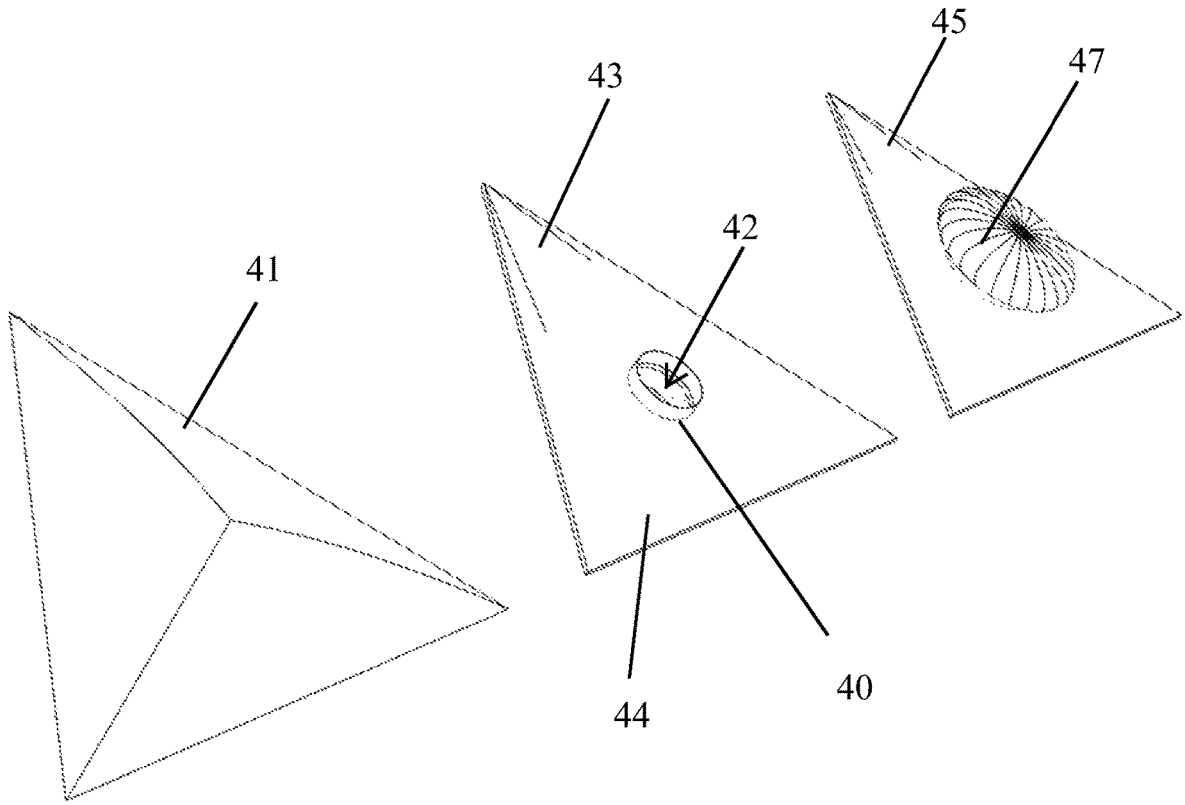
FIG. 6 is an illustration of a series of different upper frame components of the accessory frame assembly.

FIG. 6 illustrates alternative accessories formed by varying the outer frame of a triangular accessory frame assembly. This includes a window 41, through pipe 43 having a connector 40 having an opening 42 for connection thereto of a stove pipe or exhaust pipe, or vent through pipe or vent with cover 47. with the accessory being a pipe 40 though which a chimney pipe or exhaust vent can pass through. The pipe has an opening 42 that provides connection to the stovepipe of a stove inside. The panel 44 of the pipe is of a rigid construction to support any pipe connected thereto.

Figure 7:
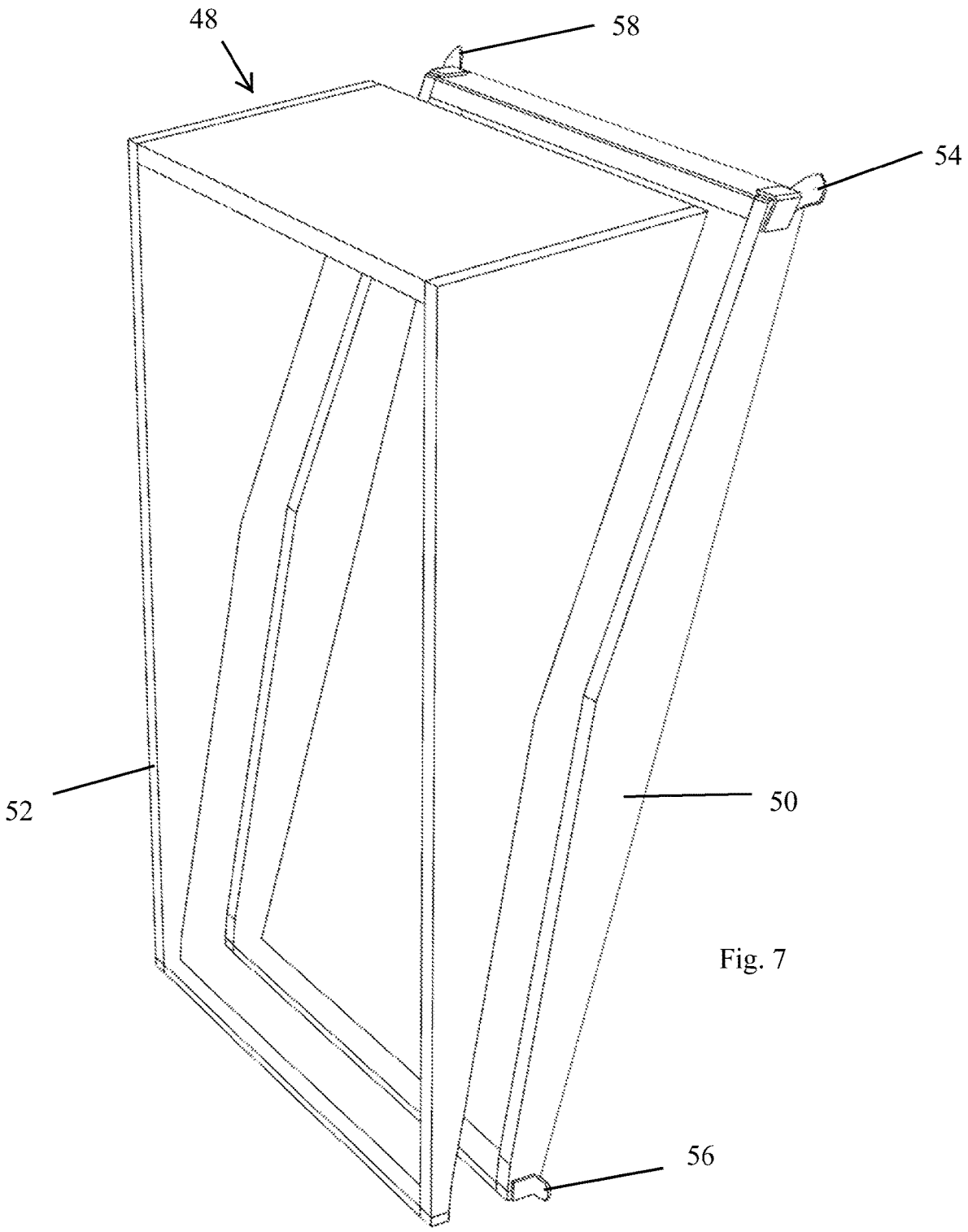
FIG. 7 illustrates an exploded view of an accessory frame assembly being a door.
Figure 14:
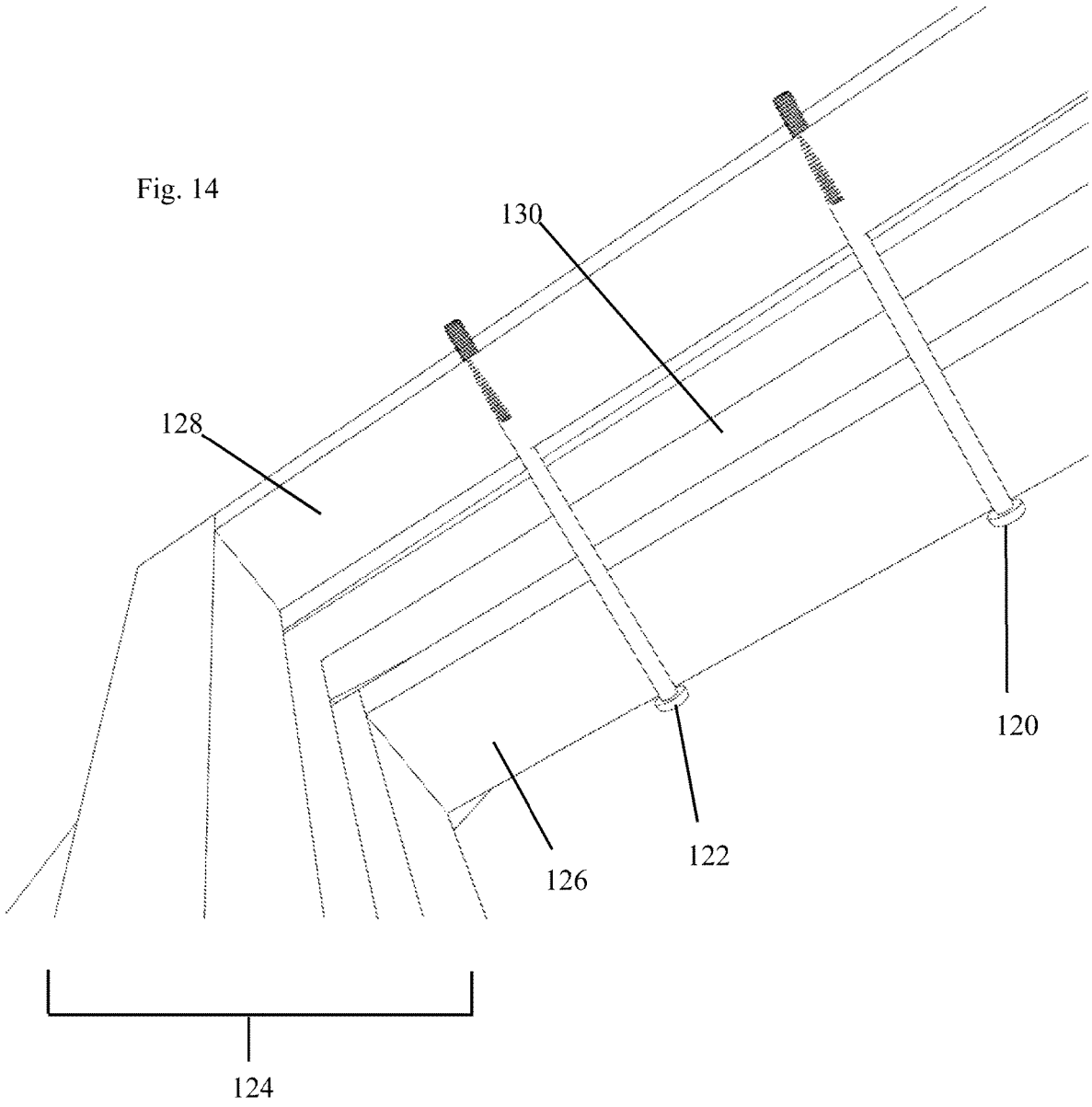
FIG. 14 illustrates the use of bolts to connect the outer frame of the accessory frame assembly to the inner frame.

FIG. 7 illustrates an alternative embodiment of an accessory being a door passage way. The door passage way is configured with an accessory frame assembly having a base frame 50 and outer frame 52. The base frame has tabs or brackets 54, 56, 58, 60 (not shown in FIG. 7) that secure the base frame to the vertices on the internal side of the dome frame. The outer frame 52 attaches to the base frame by bolts, such as illustrated in FIG. 14, or to otherwise nest with or attach to the base frame 50 such that membrane of the geodesic dome is secured between the base frame and outer frame of the accessory frame assembly.

Figure 8:
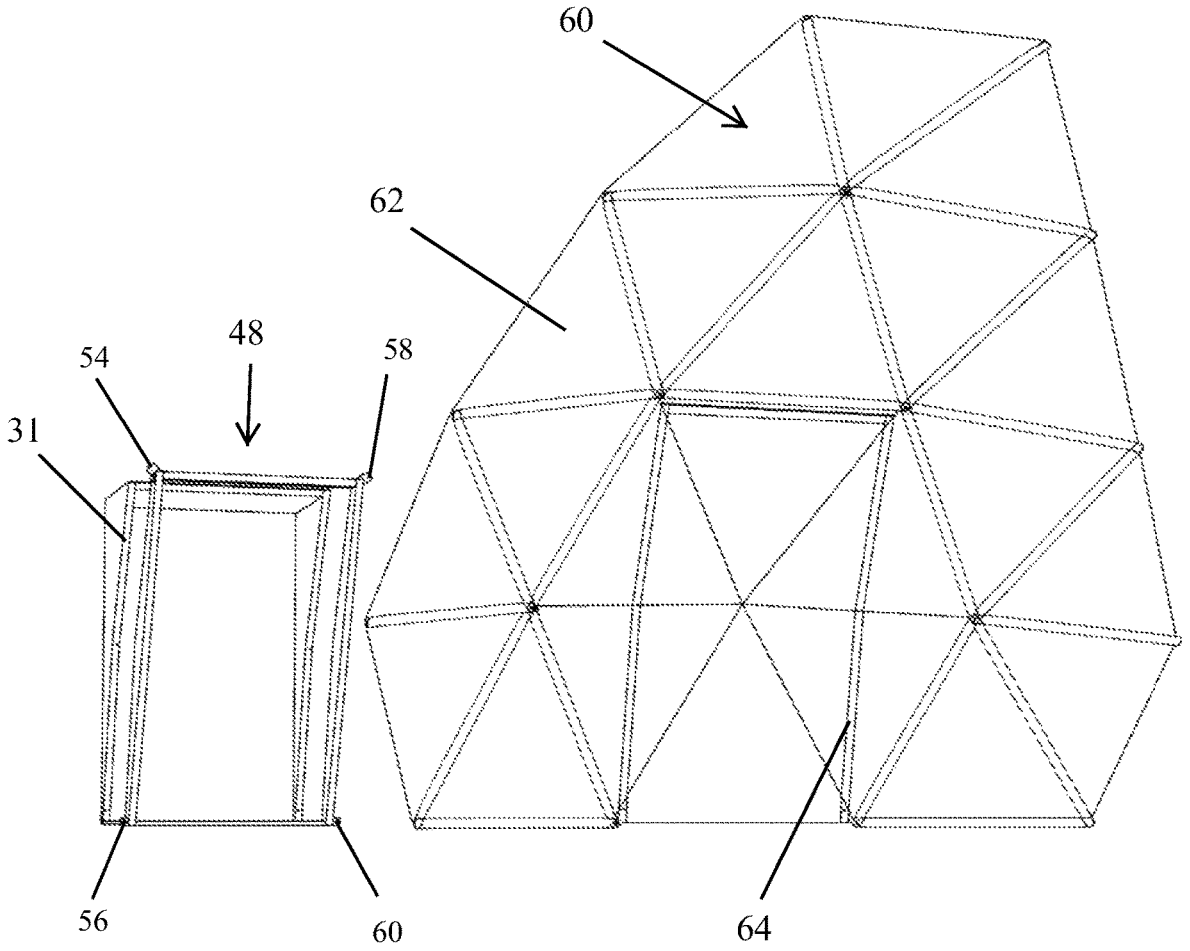
FIG. 8 illustrates an accessory frame assembly positioned adjacent to a geodesic dome frame assembly with a transparent membrane illustrating the positioning of the door in the geodesic dome.

FIG. 8 illustrates a geodesic dome 60 having the external membrane transparent 62 to illustrate the underlying frame structure. The base frame 64 of the door has been installed, and the frame parts of the geodesic dome have been removed from the triangles forming the geodesic dome frame at the door way position. The membrane is positioned across the inner frame such that the outer frame can be attached to the base frame, with the membrane clamped or secured between the outer frame and the base frame.

Figure 9:
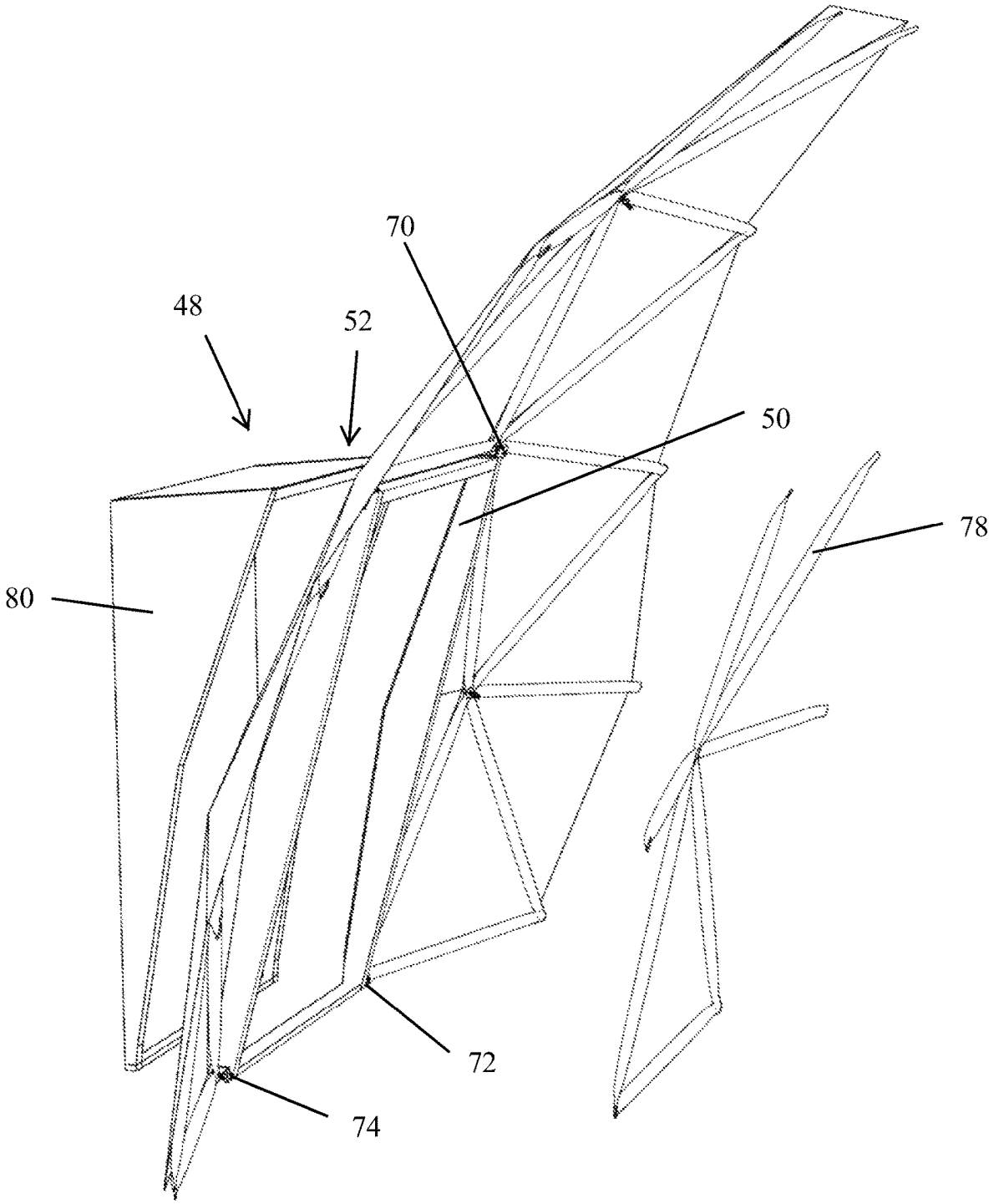
FIG. 9 illustrates a partially exploded view of a geodesic dome and door accessory showing the removed section of frame and positioning of the door accessory.

FIG. 9 illustrates the installation of the accessory 48 onto the frame of the geodesic dome. The base frame 50 is connected to the vertices 70, 72, 74, 76 of the triangles making up the periphery of the door frame. The framing elements 78 are removed where the door is being positioned. The membrane of the geodesic dome stretches over the base frame of the accessory frame assembly, and is secured between the outer frame and the base frame when the outer frame is secured to the base frame. In FIG. 9 the outer framing 52 is shown separated from the base frame, with a gap 82 illustrating where the membrane of the geodesic dome will be positioned to clamp or secure the membrane between the outer frame 80 the base frame. Installation of the door creates a clamping or sandwich effect of the outer frame 80 of the door over the membrane, between the outer frame and base frame 50 of the door accessory. The membrane covering the opening of the door way is then cut away, leaving a water resistant or water tight fit between the outer frame and base frame of the accessory frame assembly.

Figure 10:
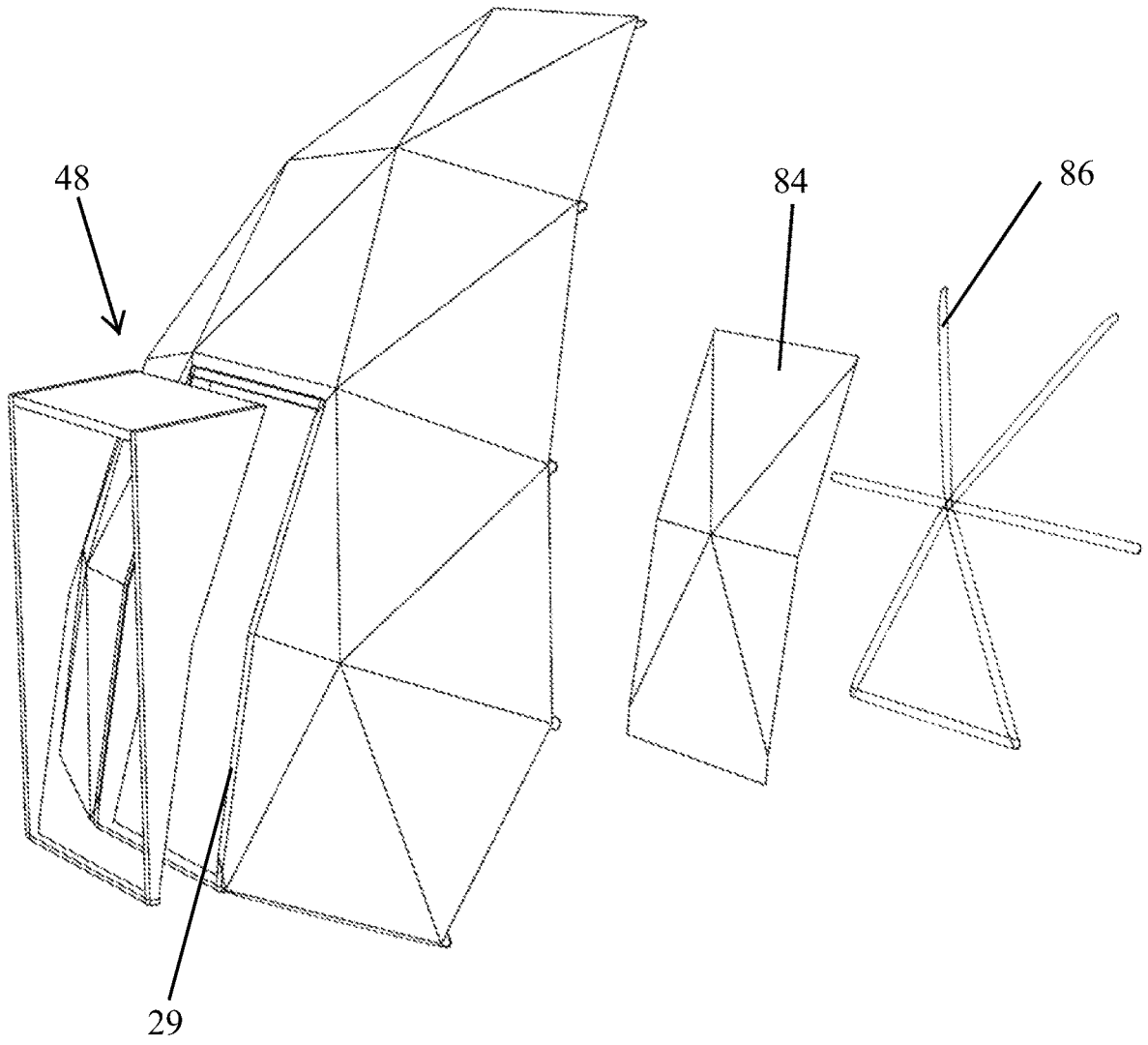
FIG. 10 illustrates a second partially exploded view of a geodesic dome illustrating the removed framing, membrane section, and installation of the base frame of the door.

FIG. 10 provides a second exploded view illustrating the removed components being the cutaway section of membrane and the removed geodesic frame elements. The membrane section 84 of the geodesic dome as well as the frame components 86 is removed following the attachment of the outer frame of the accessory frame assembly to the base frame. Sub framing can be added between the door and neighboring vertices in the event that partial framing members are removed.

Figure 11:
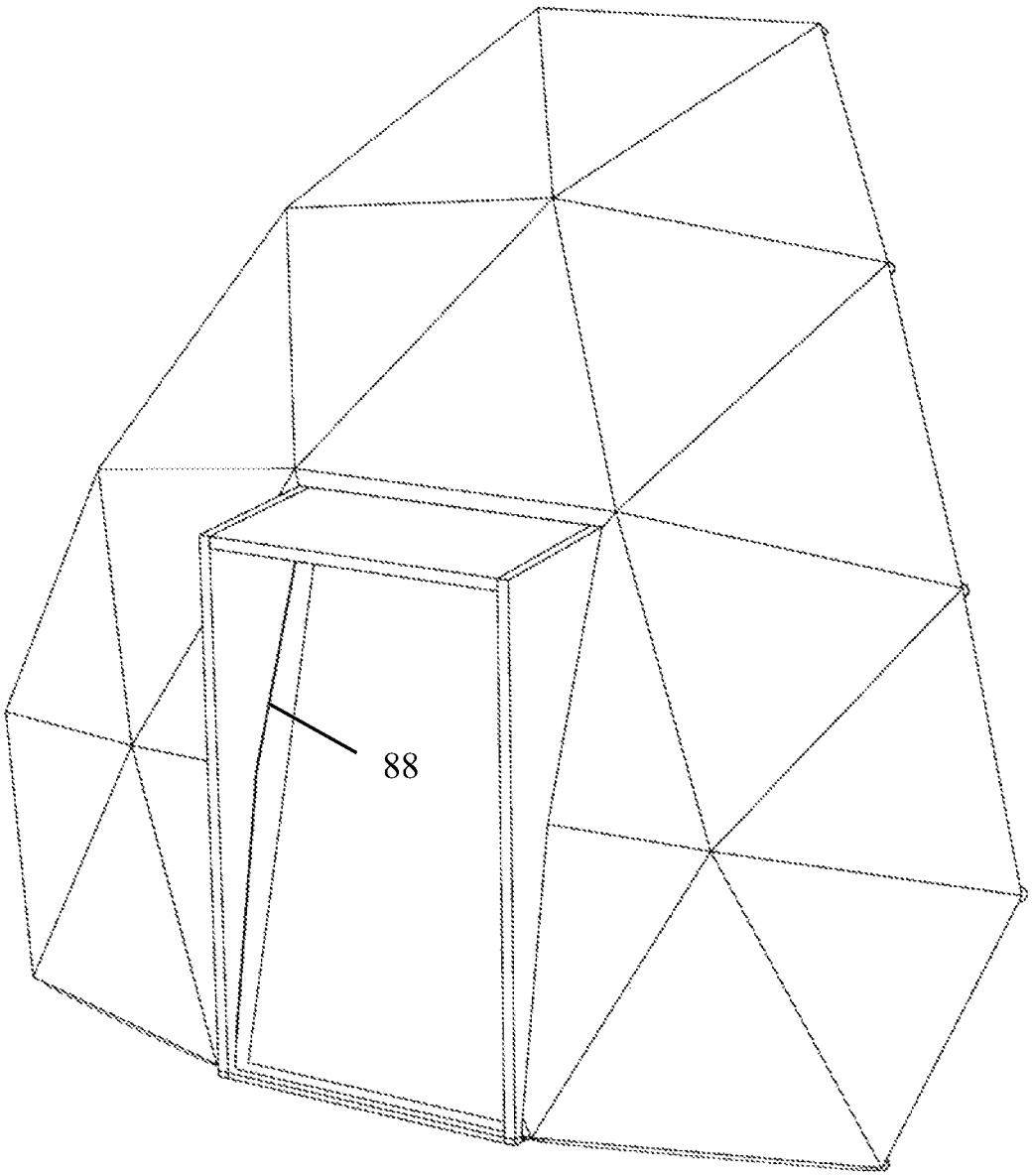
FIG. 11 illustrates an installed door accessory in a geodesic dome.

FIG. 11 illustrates a fully installed and assembled door in a geodesic dome. The base frame of the accessory frame assembly has been connected to the frame of the geodesic dome. The geodesic dome frame elements in the door opening have been removed, leaving the door passageway. The membrane 88 of the geodesic dome has been positioned over the base frame, with the upper or outer frame of the accessory frame assembly positioned over the base frame and membrane, effectively securing the membrane between the upper frame and base frame. The membrane section positioned across the door opening is then removed, providing a weather resistant door frame.

Figure 12:
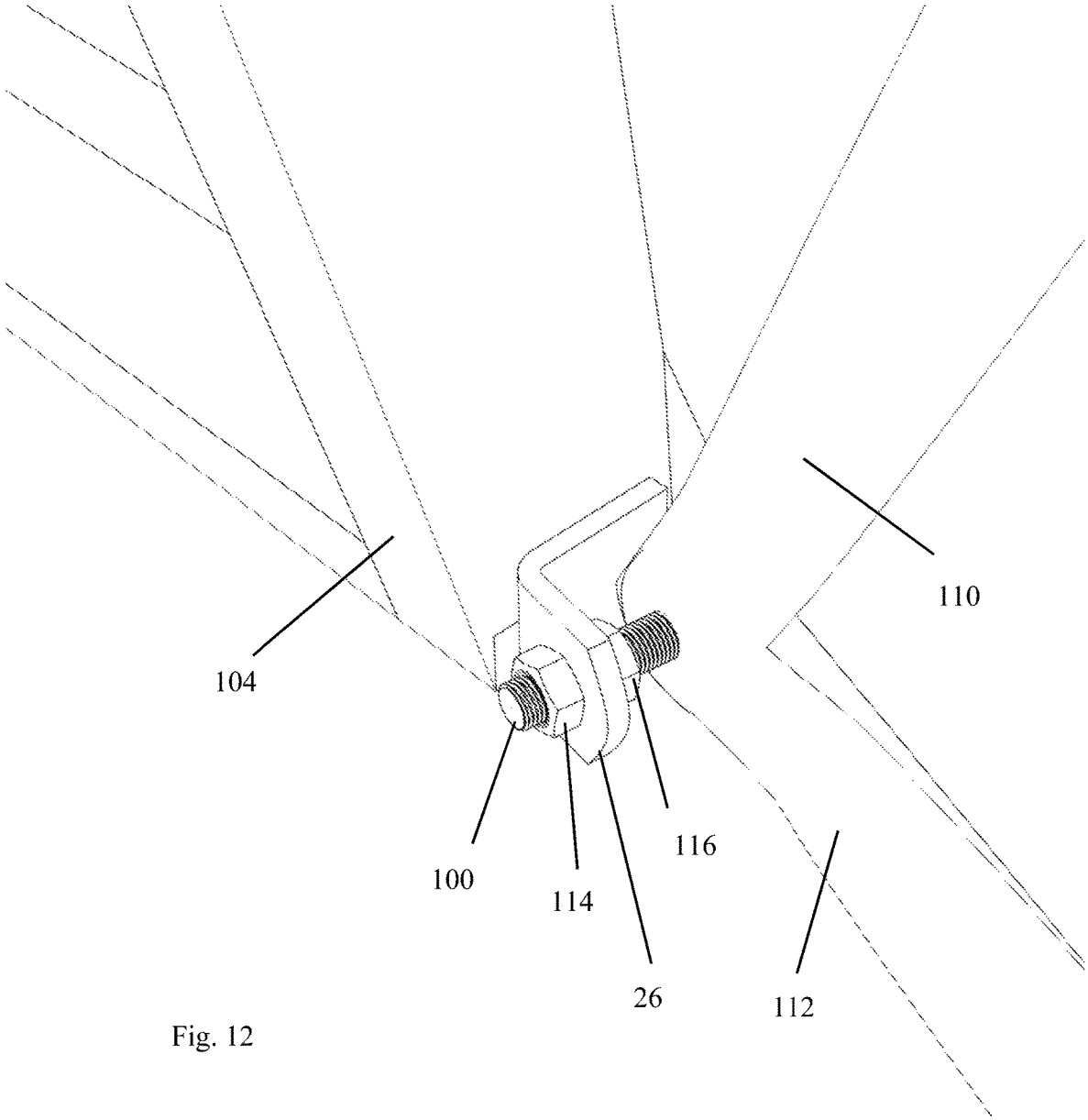
FIG. 12 illustrates a connection mechanism attaching the base frame of an accessory to a vertex of a triangle formed by the geodesic dome frame elements.
Figure 13:
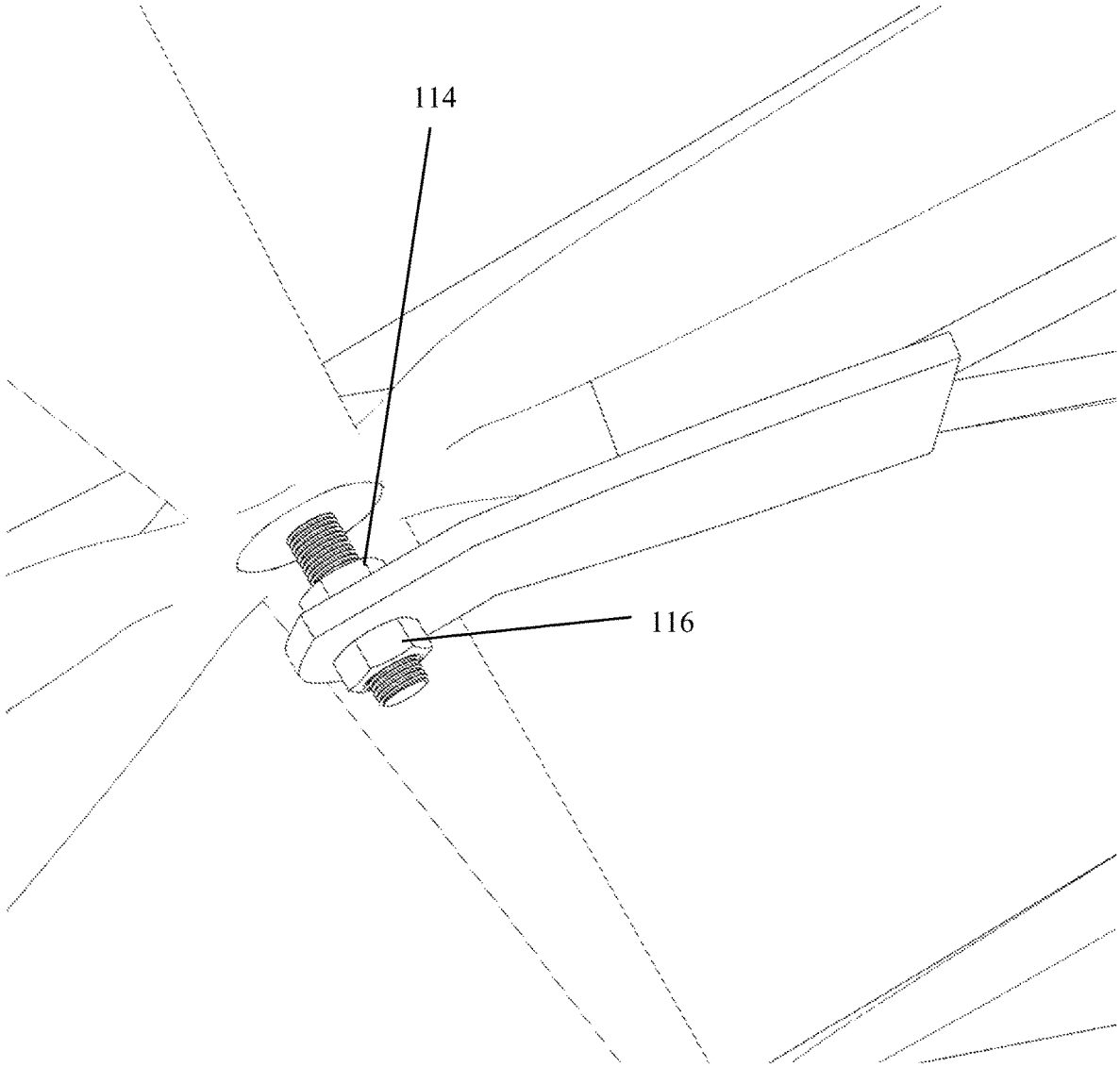
FIG. 13 illustrates a second view of a connection mechanism attaching the base frame of an accessory to a vertex of a triangle formed by the geodesic dome frame elements.

FIG. 12-13 illustrates an example of a connector 100 for connecting the connection flange 102 of the base frame 104 of the accessor frame assembly to a frame element intersection 108, such as the vertex of a triangular frame element. The illustrated connector 100 is a threaded stud that is threaded into the aligned female openings of intersecting frame elements 110, 112. The flange is positioned between two securing nuts 114, 116 that retain the connection flange in place.

FIG. 14 illustrates an example mechanism for connecting the outer frame of the accessory frame assembly to the base frame. Two bolts 120, 122 have been positioned through the outer frame 126 and base frame 128 of the accessory frame assembly 124, securing the outer frame to the base frame and securing the membrane 130 of the geodesic dome between the base frame and the outer frame.

Figure 15:
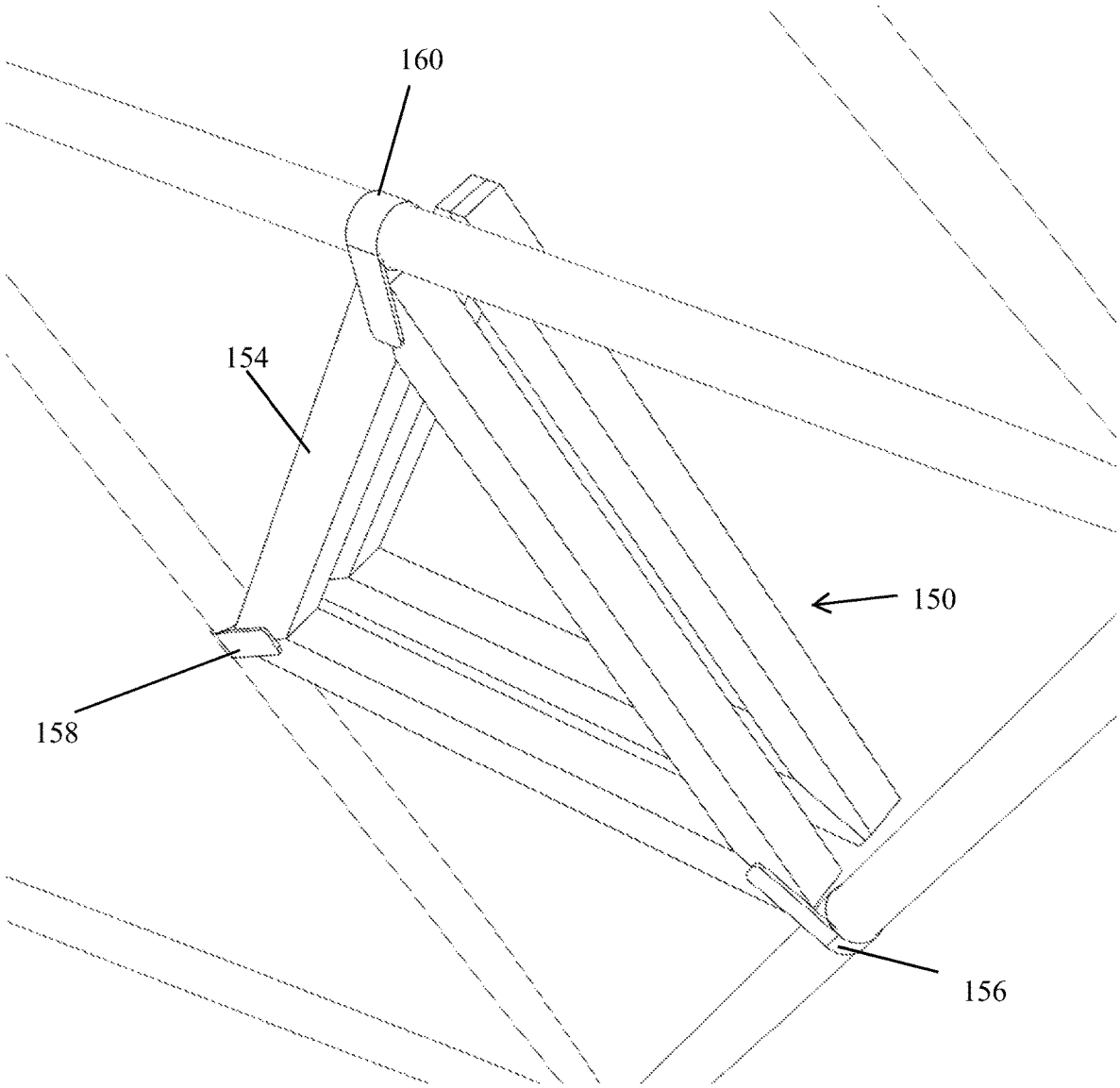
FIG. 15 illustrates a connection mechanism for connecting the base frame of the accessory frame assembly to the geodesic dome frame.

FIG. 15 illustrates an alternate mechanism for connecting the base frame of the accessory frame assembly 150 to the frame 152 of the geodesic dome. The triangular base frame 154 is connected at each vertex by a tube clamp 156, 158, 160 connecting each vertex to the tubular frame of the geodesic dome. The depicted embodiment allows for smaller accessories to be utilized that do not occupy an entire opening created by the geodesic dome frame.

Still other features and advantages of the presently disclosed and claimed inventive concept(s) will become readily apparent to those skilled in this art from the following detailed description describing preferred embodiments of the inventive concept(s), simply by way of illustration of the embodiments contemplated by carrying out the inventive concept(s). As will be realized, the inventive concept(s) is capable of modification in various obvious respects all without departing from the inventive concept(s). For example, accessories of varying shapes may be utilized according to the inventive concepts disclosed herein. Accordingly, the drawings and description of the preferred embodiments are to be regarded as illustrative in nature, and not as restrictive in nature.

While certain preferred embodiments are shown in the figures and described in this disclosure, it is to be distinctly understood that the presently disclosed inventive concept(s) is not limited thereto but may be variously embodied to practice within the scope of the following claims. From the foregoing description, it will be apparent that various changes may be made without departing from the spirit and scope of the disclosure as defined by the following claims.

What is claimed is:

1. An accessory system for use with a geodesic dome, the geodesic dome having a tubular frame structure having tubular frame elements arranged in a plurality of triangles to form a geodesic polyhedron, the triangles each having vertices that are connected to vertices of neighboring triangles, and a membrane stretched over said tubular frame structure, the accessory system comprising:

an accessory frame assembly comprising a base frame and an outer frame, said accessory frame comprising connection members configured for attachment to said tubular frame structure of said geodesic dome so as to be positioned in an opening between tubular frame elements of said geodesic dome, said base frame defining an opening;

wherein said outer frame and said base frame being configured to secure said membrane between said outer frame and said base frame such that said membrane of said geodesic dome is secured between an inner face of said outer frame and an outer face of said base frame when said accessory frame is mounted on said frame structure of said geodesic dome, wherein said base frame comprising an accessory.

2. The accessory system of claim 1, wherein said base frame and said outer frame comprise a triangle shape, wherein a connection member of said connection members is positioned at each vertex of said base frame.

3. The accessory system of claim 1 wherein said connection members comprise tabs configured with a through bolt opening for connecting said base frame to said frame of said geodesic dome, wherein said connection members are configured to attach to said frame of said geodesic dome by a bolt.

4. The accessory system of claim 1 wherein said connection members comprise frame clamps configured to clamp onto frame elements of said geodesic dome.

5. The accessory system of claim 1 wherein said outer frame defines an opening, wherein said outer frame comprises a translucent panel extending across said opening.

6. The accessory system of claim 1 wherein said outer frame comprising a rigid panel extending between frame elements of said outer frame, wherein said rigid panel comprises a pipe connector extending through said outer frame.

7. The accessory system of claim 2, wherein said base frame and said outer frame comprise a triangle shape, wherein said base frame comprises a tab at each vertex of said triangle for connection to the vertices of triangles of said tubular frame structure.

8. The accessory system of claim 1, wherein said accessory comprises a window, a door, a vent, or a coupler for passthrough of a stove pipe.

9. The accessory system of claim 1, wherein said accessory system comprises a door, wherein said base frame and said outer frame comprise a rectangular shape configured for passage therethrough of a person.

10. A method of installing an accessory system onto a geodesic dome, the geodesic dome having a tubular frame structure arranged in a plurality of triangles to form a geodesic polyhedron, the triangles each having vertices that are connected to vertices of neighboring triangles, and a membrane stretched over said tubular frame structure, the accessory system comprising the following steps:

the step of providing an accessory having a base frame and an outer frame, said base frame configured for attachment to said frame structure at said vertices of said triangles, said base frame being open on an interior of said base frame, said outer frame configured for nesting engagement with said base frame such that said membrane is clamped between said base frame and said outer frame, wherein said outer frame comprising an accessory;

the step of attaching said base frame to said tubular frame structure, the step of attaching said outer frame to said base frame with said membrane clamped between said outer frame and said base frame;

the step of removing membrane material positioned across said opening of said base frame.

11. The method of claim 10, further comprising the step of removing frame elements from said tubular frame structure following installation of said base frame.

12. A geodesic dome comprising:

a tubular frame structure having a plurality of frame elements arranged in a plurality of triangles to form a geodesic polyhedron, the triangles each having vertices that are connected to vertices of neighboring triangles, and a membrane stretched over said tubular frame structure, the accessory system comprising:

an accessory frame assembly comprising a base frame and an outer frame, said base frame comprising connection members attaching said accessory frame to said frame structure of said geodesic dome such that said base frame is positioned within an opening between said frame elements in said geodesic dome structure so as to be between frame elements of said geodesic dome, said base frame defining an opening;

wherein said outer frame is attached to said base frame such that said membrane of said geodesic dome is secured between an inner face of said outer frame and an outer face of said base frame, wherein said base frame comprising an accessory.

13. The geodesic dome of claim 12, wherein said base frame and said outer frame comprise a triangle shape, wherein a connection member of said connection members is positioned at each vertex of said base frame.

14. The geodesic dome of claim 12 wherein said connection members comprise tabs configured with a through bolt opening for connecting said base frame to said frame of said geodesic dome.

15. The geodesic dome of claim 12 wherein said connection members comprise frame clamps configured to clamp onto frame elements of said geodesic dome.

16. The geodesic dome of claim 12 wherein said outer frame defines an opening, wherein said outer frame comprises a translucent panel extending across said opening.

17. The geodesic dome of claim 12 wherein said outer frame comprising a rigid panel extending between frame elements of said outer frame, wherein said rigid panel comprises a pipe connector extending through said outer frame.

18. The geodesic dome of claim 13 wherein said base frame and said outer frame comprise a triangle shape, wherein said base frame comprises a tab at each vertex of said triangle for connection to the vertices of triangles of said tubular frame structure.

19. The geodesic dome of claim 12, wherein said accessory comprises a window, a door, a vent, or a coupler for passthrough of a stove pipe.

20. The geodesic dome of claim 12 wherein said accessory system comprises a door, wherein said base frame and said outer frame comprise a rectangular shape configured for passage therethrough of a person.

* * * * *